US008469477B2

(12) United States Patent
Hiroike

(10) Patent No.: US 8,469,477 B2
(45) Date of Patent: Jun. 25, 2013

(54) RECORDING DEVICE, RECORDING DEVICE CONTROL METHOD, AND COMPUTER-READABLE RECORDING MEDIUM THAT STORES A PROGRAM EXECUTED BY A CONTROL UNIT THAT CONTROLS THE RECORDING DEVICE

(75) Inventor: Go Hiroike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 301 days.

(21) Appl. No.: 12/943,380

(22) Filed: Nov. 10, 2010

(65) Prior Publication Data

US 2011/0205277 A1 Aug. 25, 2011

(30) Foreign Application Priority Data

Nov. 11, 2009 (JP) ..... 2009-257797

(51) Int. Cl.
*B41J 29/38* (2006.01)

(52) U.S. Cl.
USPC ..... 347/16

(58) Field of Classification Search
USPC ..... 347/16
See application file for complete search history.

(56) References Cited

U.S. PATENT DOCUMENTS

2004/0057768 A1* 3/2004 Oshino et al. ..... 400/103

FOREIGN PATENT DOCUMENTS

| | | | | |
|---|---|---|---|---|
| EP | 0416507 | A2 | | 3/1991 |
| JP | 02-169278 | A | | 6/1990 |
| JP | 02169278 | A | * | 6/1990 |
| JP | 03-093567 | A | | 4/1991 |
| JP | 11-010970 | A | | 1/1999 |
| JP | 2005-088305 | A | | 4/2005 |
| JP | 2005-186524 | A | | 7/2005 |
| JP | 2006-327130 | A | | 12/2006 |

* cited by examiner

*Primary Examiner* — Laura Martin
(74) *Attorney, Agent, or Firm* — Nutter McClennen & Fish LLP; John J. Penny, Jr.; Christina M. Sperry

(57) ABSTRACT

A recording device is provided that records images on a recording medium and cuts the recording medium. The recording device includes a printer having a print head that prints on a recording medium, a recording medium feed motor and a platen that convey the recording medium, a cutter unit that cuts the recording medium printed by the print head, and a control unit that controls the recording medium feed motor, the print head, and the cutter unit. The printer prints images by means of the print head while conveying the recording medium, stops feeding the recording medium when the recording medium is cut by the cutter unit during printing, and after the cutter unit finishes cutting the recording medium, feeds the recording medium a specific length in reverse before resuming printing by the print head.

11 Claims, 7 Drawing Sheets

RECORDING DEVICE, RECORDING DEVICE CONTROL METHOD, AND COMPUTER-READABLE RECORDING MEDIUM THAT STORES A PROGRAM EXECUTED BY A CONTROL UNIT THAT CONTROLS THE RECORDING DEVICE

CROSS REFERENCE TO RELATED APPLICATIONS

This application claims priority under 35 U.S.C. §119 to Japanese Patent Application No. 2009-257797 filed on Nov. 11, 2009, the entire disclosure of which is expressly incorporated by reference herein.

BACKGROUND

1. Technical Field

The present invention relates to a recording device that records on a recording medium and that cuts the recording medium, to a control method that controls a recording device, and to a program that controls a recording device.

2. Related Art

Recording devices used in point-of-sale (POS) systems are commonly used in supermarkets, convenience stores, and other retailers. The recording devices typically have a recording head that prints on roll paper or other recording medium and a cutter for cutting the printed recording medium in order to print and issue a receipt. See, for example, Japanese Unexamined Patent Appl. Pub. JP-A-2008-210097.

In order to not waste recording media as a result of the recording head and the cutter being separated from each other, a recording device with a cutter such as taught in JP-A-2008-210097 may also print by means of the recording head on a trailing portion of the recording medium between the recording head and the cutter when the printed portion is cut off. In this situation, conveying and printing on the recording medium stop (pause) while the medium is cut, and then resume after the recording medium is cut. As a result of printing stopping and then starting again, a band of white space may be formed widthwise to the recording medium, that is, perpendicularly to a media transportation direction, at the position where the recording medium was stopped. The white space detracts from print quality because it is conspicuous even though it is may be extremely narrow. The white space results from a shift in the relative positions of the recording head and the recording medium when conveyance of the recording medium pauses and when it resumes. This cannot be easily eliminated and is primarily due to shifting caused by backlash in gears of the transportation mechanism and elastic deformation of rubber members such as a platen, and the effect of tension applied to the recording medium during cutting. Avoiding such white space is thus a difficult problem.

SUMMARY

At least one embodiment of the present invention can generally achieve good print quality on a recording medium even when a printing operation is paused for cutting the recording medium in a recording device that records images on the recording medium and that cuts the recording medium.

A recording device according to at least one embodiment of the present invention has a recording head that records an image on a recording medium, a transportation unit that conveys the recording medium, a cutter unit that cuts the recording medium on which image data for the image is recorded by the recording head, a control unit that controls the recording head, the cutter unit, and the transportation unit, and an image storage unit that stores the image data for the image recorded on the recording medium. The control unit conveys the recording medium by means of the transportation unit, causes the recording head to record the image on the recording medium based on the image data stored in the image storage unit, stops conveyance and cuts the recording medium by means of the cutter unit at a specific recording position in the image recorded by the recording head. When cutting the recording medium ends, the control unit conveys the recording medium a specific length in reverse by means of the transportation unit, and then, with the recording medium conveyed the specific length, resumes recording the image by the recording head including within a portion of the image already recorded before conveying the recording medium stopped.

The recording device can have any number of variations. For example, when the recording medium is conveyed in reverse by means of the transportation unit and recording by the recording head resumes, the control unit can record within the portion of the image already recorded before conveyance of the recording medium stopped with a lighter gray level than a gray level used to already record within the portion of the image. For another example, an image can be recorded on a recording surface of the recording medium by applying energy to the recording head, and when the recording medium is conveyed in reverse by means of the transportation unit and recording by the recording head resumes, the control unit can apply less energy to the recording head while recording the image within the portion of the image already recorded before conveyance stopped. For yet another example, the recording head can resume recording the image within an entire portion of the image already recorded before conveying the recording medium stopped In at least one embodiment, the recording medium can include thermal paper that produces color in response to heat, and the recording head includes a line thermal head having heat elements that contact and apply heat to a recording surface of the recording medium arrayed widthwise to the recording medium. The control unit can energize the recording head and record on the recording medium while conveying the recording medium by means of the transportation unit, stop paper conveyance by the transportation unit and stop energizing the recording head when the recording medium is cut by the cutter unit during recording, resume energizing the recording head and paper conveyance by the transportation unit after conveying the recording medium in reverse a specific length after cutting the recording medium by the cutter unit ends, and while recording a first predetermined length after printing resumes, energizes the recording head with less electric energy than an electric energy applied when previously recording within the portion of the image.

In another aspect, a recording device control method is provided that in at least one embodiment controls a recording device that stores image data for an image on a recording medium, records the image on a recording medium by means of a recording head, conveys the recording medium by means of a transportation unit, and cuts the recording medium on which the image was recorded by the recording head by means of a cutter unit. The control method includes the steps of conveying the recording medium by means of the transportation unit, recording on the recording medium by means of the recording head based on the image data for the image stored in the image storage unit, stopping conveyance by the transportation unit and cutting the recording medium by means of the cutter unit at a specific recording position in the image recorded by the recording head, and when cutting the recording medium ends, conveying the recording medium a specific length in reverse by means of the transportation unit, and then, with the recording medium conveyed the specific length, resuming recording the image by the recording head including within a portion of the image already recorded before conveying the recording medium stopped.

In another aspect, a computer-readable recording medium is provided that in at least one embodiment stores a program executed by a control unit that controls a recording device that stores image data for an image on a recording medium, records the image on a recording medium by means of a recording head, conveys the recording medium by means of a transportation unit, and cuts the recording medium on which the image was recorded by the recording head by means of a cutter unit. The program includes steps of conveying the recording medium by means of the transportation unit, recording on the recording medium by means of the recording head based on the image data for the image stored in the image storage unit, stopping conveyance by the transportation unit and cutting the recording medium by means of the cutter unit at a specific recording position in the image recorded by the recording head, and when cutting the recording medium ends, conveying the recording medium a specific length in reverse by means of the transportation unit, and then, with the recording medium conveyed the specific length, resuming recording the image by the recording head including within a portion of the image already recorded before conveying the recording medium stopped.

Other objects and attainments together with a fuller understanding of the invention will become apparent and appreciated by referring to the following description and claims taken in conjunction with the accompanying drawings.

DESCRIPTION OF EMBODIMENTS

In at least one embodiment of the invention, a recording device that conveys a recording medium and records an image by means of a recording head stops feed of the recording medium by a transportation unit when the recording medium is to be cut by a cutter unit during recording. When cutting the recording medium is completed, the recording device conveys the recording medium a specific length in an opposite direction from a normal feed direction and then resumes recording. As a result, recording overlaps for a specific length at a position where recording stopped, and formation of a band of white space can be prevented when recording stops and resumes even when positions of the recording head and the recording medium have shifted between when recording stops and resumes. A band of white space is therefore not formed even when recording stops and the recording medium is cut, and good print quality can be achieved.

In this configuration, because the recording medium is fed a specific length in reverse after cutting of the recording medium ends, and recording backs up and resumes, an image of a specific length that was already printed is printed again over a previously printed portion of the same length. In other words, because the recording medium is reversed and the same data is recorded again for a specific length, formation of bands of white space can be prevented and an odd appearance can be avoided in the part that is printed over again. The total recording length also does not change because the recording medium is fed a specific length in reverse.

A preferred embodiment of the present invention is described below with reference to the accompanying figures.

Figure 1:
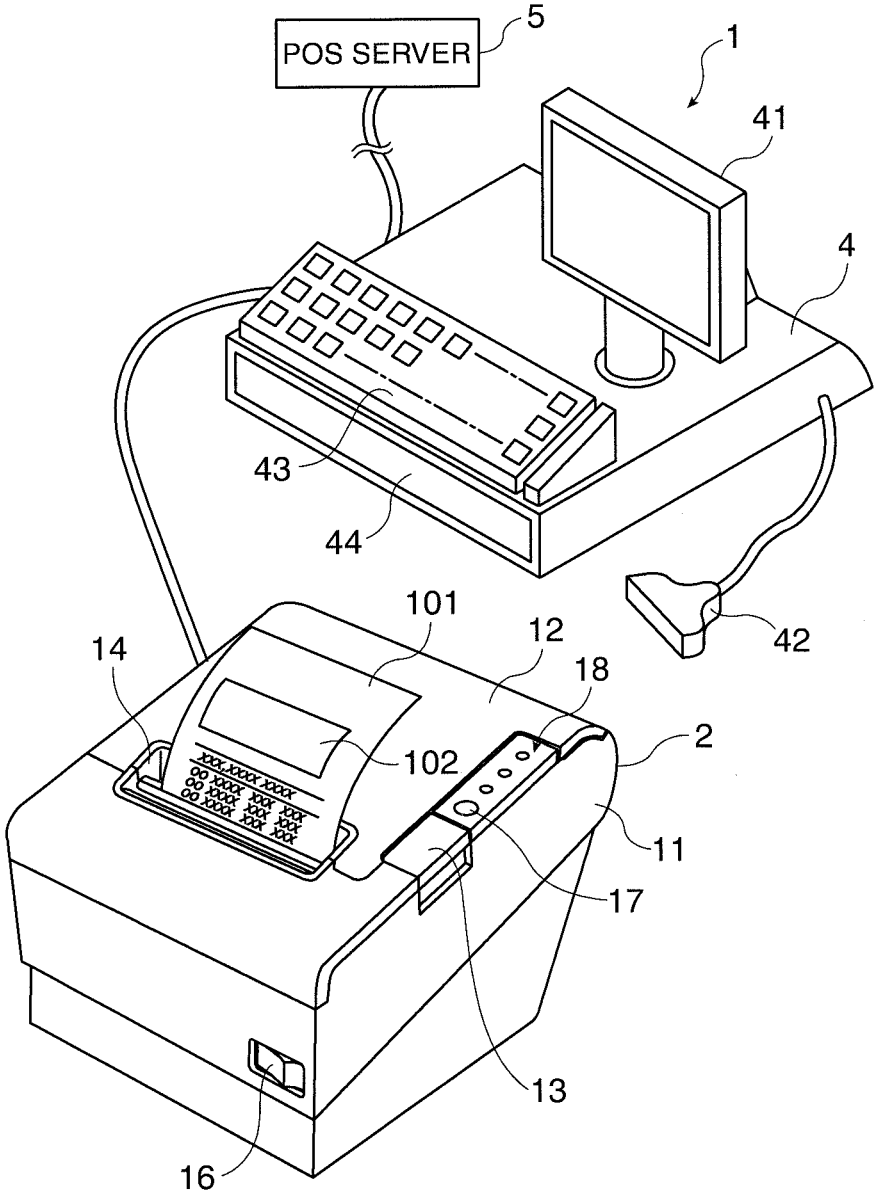
FIG. 1 shows a perspective view of a point-of-sale management (POS) terminal including a printer according to one embodiment of the invention.
Figure 2:
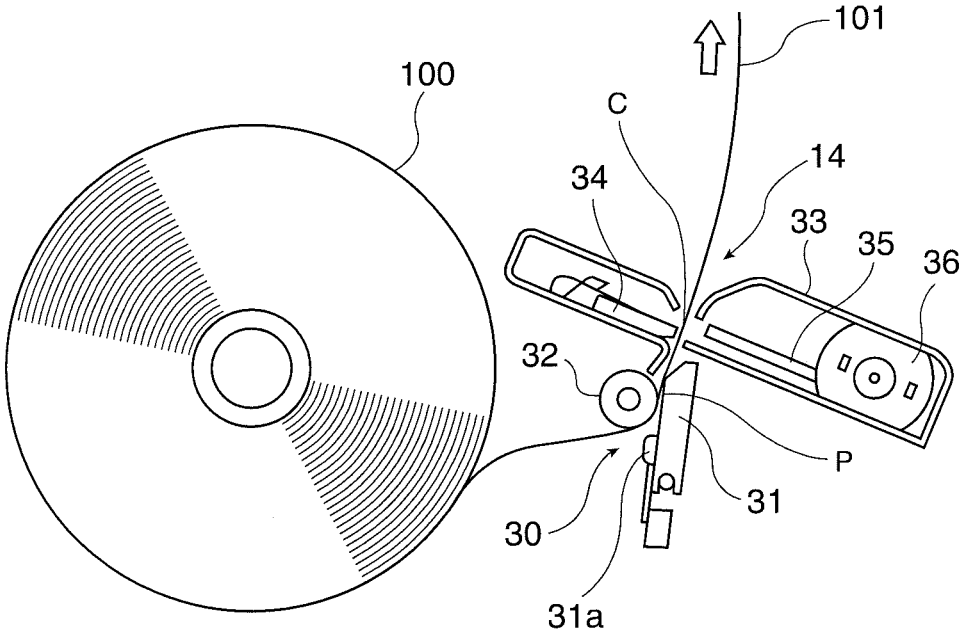
FIG. 2 schematically shows an internal configuration of the printer of FIG. 1.

FIG. 1 shows the general configuration of a point-of-sale (POS) terminal 1 according to a preferred embodiment of the invention. FIG. 2 schematically shows an internal configuration of a recording device, e.g., a printer 2, disposed to the POS terminal 1.

The POS terminal 1 shown in FIG. 1 includes a cash register disposed at a checkout counter in a retail store, for example, for processing sale transactions, and is part of a POS management system (POS system). The POS terminal 1 includes a printer 2 for issuing receipts 101 connected to a host computer 4 that executes a sale registration process and a transaction process. The host computer 4 can thus be a device externally connected to the printer 2. The host computer 4 can also be connected through a communication line to a POS server 5 that collects the input sale information.

The host computer 4 can have a display 41 that displays content of the sale registration and transaction processes, a barcode scanner 42 that reads product barcodes during the sale registration process, a key input device 43 including keys for entering and finalizing transaction information, and a cash drawer 44 for storing cash and receivables used to pay for transactions.

As shown in FIG. 1 and FIG. 2, the printer 2 used in this embodiment of the invention as a recording device stores roll paper 100, e.g., thermal roll paper, e.g., a heat sensitive sheet, as a recording medium stored inside a case 11, and prints, e.g., records, on the roll paper 100 by means of a print unit 30.

The print unit 30 includes a roller-shaped platen 32 for conveying the roll paper 100, a recording head, e.g., a print head 31, disposed opposite the platen 32, and a cutter unit 33 that cuts the roll paper 100 at a position downstream from the print unit 30 on the roll paper 100 transportation path. Note that in this embodiment, the platen 32 functions as at least part of a transportation unit.

The print head 31 in this embodiment is a line thermal head composed of heat elements (not shown in the figures) arrayed in one or multiple lines across a width of the roll paper 100. In this embodiment of the invention, for example, the print head 31 with an 8 dot/mm print resolution has an effective printing width of 80 mm and one or more lines with 640 heat elements per line. The heat elements are individually energized by a motor driver 24 described below. The print head 31 is urged toward the platen 32 by a spring (not shown in the figures), and holds the roll paper 100 between the print head 31 and the platen 32 with a specified pressure. As a result, the print head 31 is pressed firmly against a recording surface, e.g., a printing surface, of the roll paper 100 and causes the roll paper 100 to produce color by applying heat energy to the roll paper 100.

A color density or print density of the roll paper 100 can be controlled by adjusting a heat output of the heat elements disposed to the print head 31 and a feed rate of the roll paper 100. The heat output of the heat elements can be adjusted by varying voltage (such as 24 V), pulse width (such as 0.3 ms), and heating cycle (such as 1 ms) of a pulse current output by the motor driver 24 to the individual heat elements of the print head 31.

The roll paper 100 printed by the print head 31 is conveyed by the platen 32 toward a paper exit 14 formed in a top of the printer case 11, cut by the cutter unit 33 disposed downstream in a transportation direction from an end of a printing position, and output as a receipt 101. In addition to, e.g., store name, names of purchased products, product quantities, prices, and total sale amount information printed as text on the roll paper 100, an image or logo such as a top logo 102 can be printed at a leading end of the receipt 101.

As shown in FIG. 2, the cutter unit 33 of the printer 2 can include a fixed knife 34 disposed on one side of the roll paper 100 transportation path, a movable knife 35 disposed on an opposite side of the roll paper 100 transportation path opposing the fixed knife 34, and a cutter drive motor 36 that drives the movable knife 35 to slide against the fixed knife 34. Drive power from the cutter drive motor 36 causes the movable knife 35 to move toward the fixed knife 34 and cut the printed roll paper 100 disposed between the fixed knife 34 and the movable knife 35.

As shown in FIG. 2, there is a gap along the roll paper 100 transportation path between a cutting position C where the cutter unit 33 cuts the roll paper 100 and a printing position P where the print unit 30 prints on the roll paper 100. As a result, so that the receipt 101 is not cut through content printed thereon when cutting the receipt 101, the receipt 101 is advanced until the last line of text or image printed at the printing position P is on the downstream side of the cutting position C, which is downstream from the printing position P.

As shown in FIG. 1, a cover 12 that can open and close can be disposed to the case 11 of the printer 2. A lever 13 for opening the cover 12 can also be disposed to the case 11. When the cover 12 opens, a space in which the roll paper 100 is stored is exposed and the roll paper 100 can be loaded or replaced. A power switch 16 for turning the printer 2 power on and off, a paper feed switch 17 for advancing the roll paper 100 or changing an operating mode under specific control conditions, for example, and an light-emitting diode (LED) group 18 for displaying an operating status of the printer 2, for example, can also be disposed to the case 11.

Figure 3:
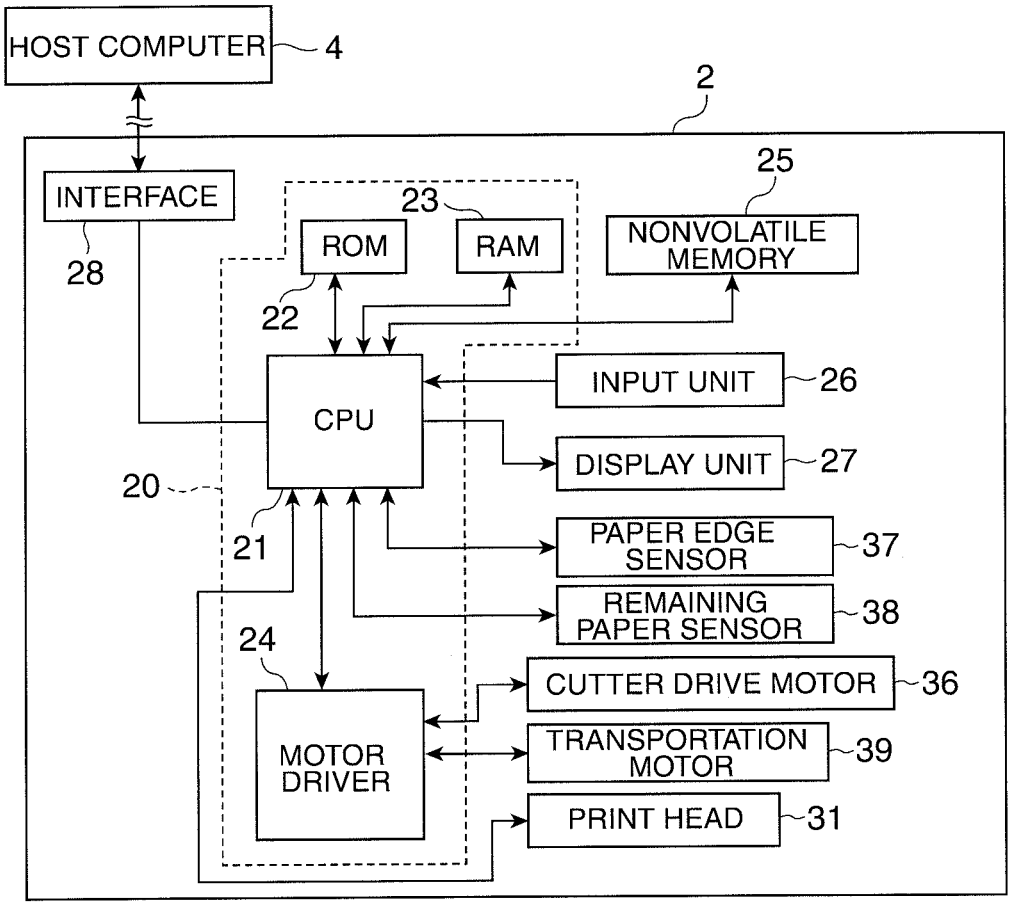
FIG. 3 is a block diagram showing a circuit design of the printer of FIG. 1.

FIG. 3 is a block diagram showing a circuit configuration of the printer 2.

The printer 2 can have a control unit 20 that controls printer 2 operations, and other units that operate as controlled by the control unit 20. The control unit 20 can include a central processing unit (CPU) 21 that controls operations by executing a specific program and processing data, read-only memory (ROM) 22 in which a basic control program executed by the CPU 21 is stored, random access memory (RAM) 23 used as working memory to temporarily store process data and the program executed by the CPU 21, and a motor driver 24 that drives motors as controlled by the CPU 21. A memory switch and nonvolatile memory 25 that nonvolatilely stores processed data are also connected to the CPU 21. The nonvolatile memory 25 can be more specifically rendered by electrically erasable programmable read-only memory (EEPROM) flash memory, or other semiconductor storage device.

Also connected to the CPU 21 are an input unit 26 that detects operation of the paper feed switch 17, a display unit 27 that controls the LED group 18 to display information, a paper edge sensor 37 that detects the presence of roll paper 100 at that position, a remaining paper sensor 38 that detects if an amount of remaining roll paper 100 is less than a specified amount, and an interface 28 that controls sending and receiving commands and data between the printer 2 and the host computer 4.

While monitoring the position of the roll paper 100 and how much roll paper 100 is left based on output from the paper edge sensor 37 and the remaining paper sensor 38, the CPU 21 executes control commands input from the host computer 4 through the interface 28, causes the print head 31, the cutter drive motor 36, and the transportation motor 39 to operate by means of the motor driver 24, controls the print head 31, and prints on the roll paper 100. When operation of the paper feed switch 17 is detected by the input unit 26, the CPU 21 operates the transportation motor 39 to advance the roll paper 100 a specified distance. The CPU 21 also changes the output state of the LEDs on the LED group 18 by means of the display unit 27 according to the operating status of the printer 2.

The cutter drive motor 36 and the transportation motor 39 that drives the platen 32 are connected to the motor driver 24. The print head 31 has a head driver 31*a* (shown in FIG. 2), and the CPU 21 controls the head driver 31*a* to supply drive current to the heat elements of the print head 31 and print on the roll paper 100. The motor driver 24 also supplies drive power and outputs the required number of drive pulses to the cutter drive motor 36 and transportation motor 39, which are rendered by stepper motors. The transportation motor 39 causes the platen 32 to rotate and thereby functions as the transportation unit that conveys the roll paper 100.

Printing on the roll paper 100 is done by energizing and causing the heat elements of the print head 31 to output heat while in contact with the printing surface of the roll paper 100 so that the roll paper 100 produces color while the roll paper 100 is advanced by means of the transportation motor 39 and the platen 32. The feed rate of the roll paper 100 and the power supplied to the print head 31 are determined by the motor driver 24 or a command processor 203 according to a data processing speed of the printer 2 and a density of the color produced in the roll paper 100.

To cut the roll paper 100, the motor driver 24 stops the transportation motor 39 to pause the roll paper 100, then drives the cutter drive motor 36 to cut the roll paper 100 by means of the cutter unit 33. After the movable knife 35 of the cutter unit 33 reaches the cutting position, the motor driver 24 reverses the cutter drive motor 36 and returns the movable knife 35 to the original position, and operation of the transportation motor 39 then resumes.

Figure 4:
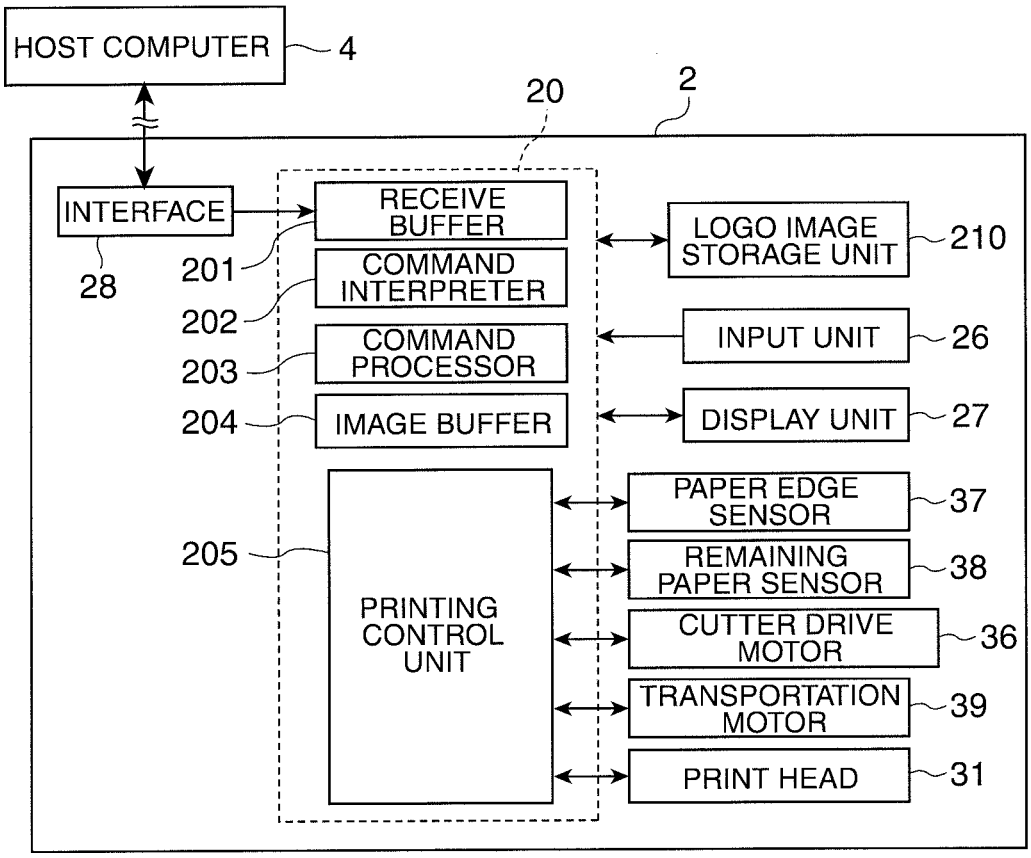
FIG. 4 is a function block diagram showing a functional configuration of the printer of FIG. 1.

FIG. 4 is a function block diagram showing a functional configuration of the printer 2. The blocks shown in FIG. 4 denote functions that can be rendered by the hardware components of the printer 2 shown in FIG. 3, or by cooperation of hardware and software.

The control unit 20 includes a receive buffer 201 that temporarily stores commands and data received from the host computer 4 through the interface 28; a command interpreter 202 that detects commands stored in the receive buffer 201 and interprets the type and content of the commands; a command processor 203 that executes processes according to the commands detected by the command interpreter 202; an image storage unit, e.g., an image buffer 204, that temporarily stores image data for the print images containing text and/or logo, for example, that are printed on the roll paper 100; and a printing control unit 205 that controls printing on the roll paper 100.

The printer 2 also has a logo image storage unit 210 that stores logo image data as controlled by the control unit 20. The logo image storage unit 210 is a storage area reserved in nonvolatile memory 25 (shown in FIG. 3) where logo image data is stored nonvolatilely.

The receive buffer 201 is a volatile storage unit rendered by RAM 23 (shown in FIG. 3) that stores data received through the interface 28 in the order received without discriminating commands and data.

The command interpreter 202 sequentially reads the data stored in the receive buffer 201 in the order received, and determines if the read data includes a command or not. More specifically, the command interpreter 202 detects commands in the data stored in the receive buffer 201.

The command processor 203 reads data determined to be a command by the command interpreter 202 from the receive buffer 201, and executes the command. Commands sent from the host computer 4 can be accompanied by the data to be processed, such as when print data is sent from the host computer 4 following a print command and stored in the receive buffer 201, or when a logo registration command, for example, is sent together with the image data to be saved from the host computer 4, and the received command and data are stored in the receive buffer 201.

When printing image data stored as a logo in the logo image storage unit 210 is specified by a print command received from the host computer 4, the command processor 203 reads the image data from the logo image storage unit 210. Based on the data received following the print command and the image data read from the logo image storage unit 210, the command processor 203 writes image data for the print image containing one or more images, text, or symbols to be printed on the roll paper 100 to the image buffer 204.

The image buffer 204 is a volatile storage unit rendered by the RAM 23 (shown in FIG. 3), and is used as working memory for storing image data for the print image to be printed on the roll paper 100 by the printing control unit 205.

As controlled by the command processor 203 and based on output from the paper edge sensor 37 and the remaining paper sensor 38, the printing control unit 205 controls the print head 31, the transportation motor 39, and the cutter drive motor 36, and prints the image data written to the image buffer 204 on the roll paper 100.

Figure 5:
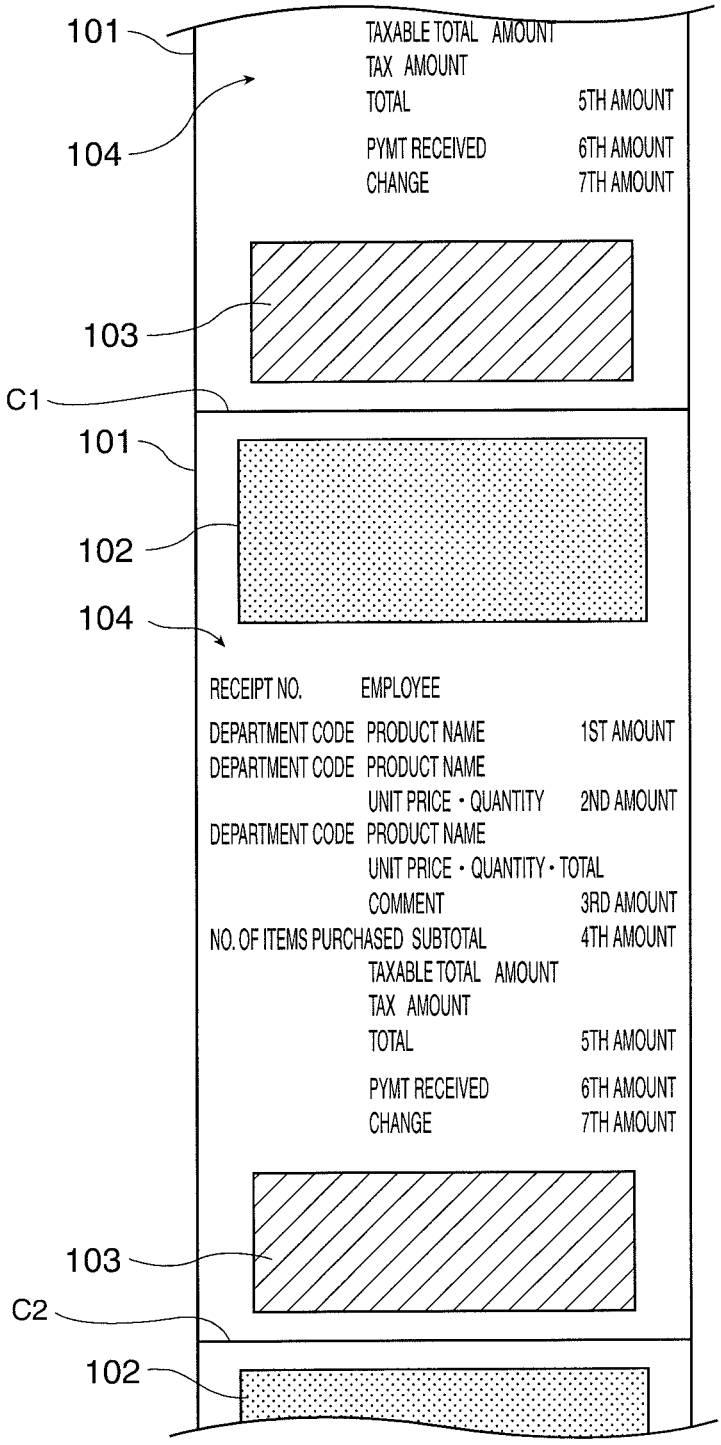
FIG. 5 shows one embodiment of a receipt printed by the printer of FIG. 1.

FIG. 5 shows an example of a receipt 101 printed by the printer 2.

FIG. 5 shows a plurality of receipts 101, which are actually cut and separated from each other, connected together so that positions where the receipts 101 are cut apart can be more easily understood. Plural receipts 101 are not normally discharged from the paper exit 14 (shown in FIG. 1) while still connected together. Positions where the receipts 101 are cut apart by the cutter unit 33 are indicated in FIG. 5 as first and second cutting positions C1 and C2.

As shown in FIG. 5, the receipt 101 of which the first and second cutting positions C1 and C2 are respectively the top and bottom ends has a top logo 102 printed at the top and a bottom logo 103 printed at the bottom, and details about the transaction processed by the POS terminal 1 printed in a detail printing area 104 between the top logo 102 and the bottom logo 103.

Because the cutting position C of the cutter unit 33 and the printing position P of the print head 31 are separated from each other as illustrated in this embodiment shown in FIG. 2, the receipt 101 is advanced so that the first cutting position C1 is at the cutting position C of the cutter unit 33 in order to cut at the trailing end of the receipt 101. In order to not waste roll paper 100, the print head 31 prints the leading end part of the next receipt 101 before the trailing end of the print data receipt 101 reaches the cutting position C at this time. For example, when the first cutting position C1 shown in FIG. 5 is at the cutting position C of the cutter unit 33, the print head 31 is still printing the top logo 102 on the next receipt 101. Because the top logo 102 printed at the top end of each receipt 101 is constant, the top logo 102 can be printed without receiving the print data for the next receipt 101.

Furthermore, because the printer 2 prints by means of the print head 31, which in this exemplary embodiment is a line thermal head, while conveying the roll paper 100 at a constant feed rate, the roll paper 100 is always moving during printing. As a result, the roll paper 100 is cut by the cutter unit 33 after first stopping the transportation motor 39 when the first cutting position C1 reaches the cutting position C of the cutter unit 33. The print head 31 also stops at a position part way through the top logo 102 at this time, and the motor driver 24 therefore also applies control to stop energizing the print head 31.

The transportation motor 39 resumes feeding the paper when the cutter unit 33 finishes cutting, but white space can be left at the position where the print head 31 stopped as a result of stopping to cut the paper. This results from a shift in the relative positions of the roll paper 100 and the print head 31 when paper feed stops and starts due, for example, to elastic deformation of a synthetic rubber layer disposed on a surface of the platen 32 and backlash in gears of the mechanism (not shown in the figures) transferring drive power from the transportation motor 39 to the platen 32 caused by stopping and restarting paper feed, and tension applied to the roll paper 100 by the movable knife 35.

Figure 6A:
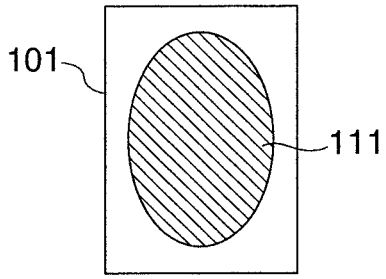
FIG. 6A shows one embodiment of an image to be printed by a printer.
Figure 6D:
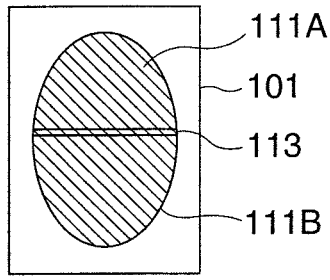
FIG. 6D shows the image of FIG. 6C when the printer resumes printing and no white space is formed.
Figure 6B:
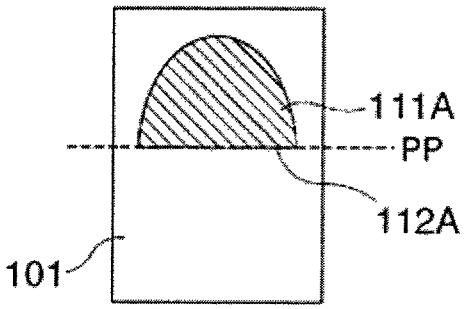
FIG. 6B shows the image of FIG. 6A when the printer is paused for cutting.
Figure 6E:
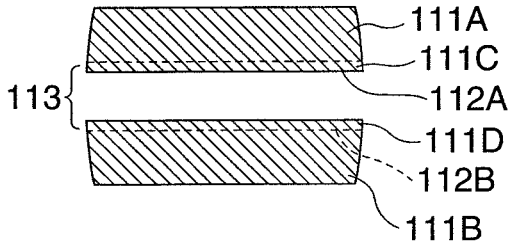
FIG. 6E schematically illustrates a method of avoiding forming white space.
Figure 6C:
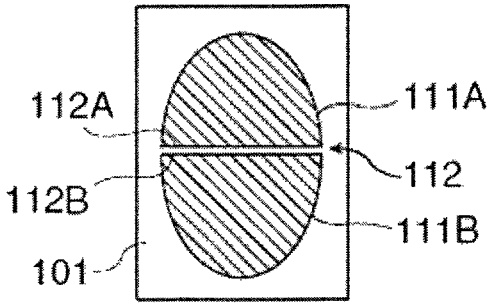
FIG. 6C shows the image of FIG. 6B when the printer resumes printing and white space is formed.

FIGS. 6A-6E illustrate operation when printing is interrupted. FIG. 6A shows one embodiment of a complete image, an oval image 111, to be printed, FIG. 6B shows when printing is paused for cutting, FIG. 6C shows a sample printout when printing resumes and white space is formed, FIG. 6D shows a sample printout when printing is resumed using a method that avoids forming white space, and FIG. 6E schematically illustrates a method of avoiding forming white space. A situation in which the oval image 111 is printed on the receipt 101 as shown in FIG. 6A and paper feed and printing are interrupted partway through the oval image 111.

This example anticipates interrupting, e.g., pausing, printing when the image 111 has been partially printed as shown in FIG. 6B. When paper feed is interrupted, the print head 31 is located at a pause position PP shown in FIG. 6B. The end of an already printed portion 111A of the oval image 111 is at end 112A.

After paper feed by the transportation motor 39 and the platen 32 stops as shown in FIG. 6B, the paper is cut by the cutter unit 33, and paper feed and printing resume, the remaining portion 111B of the oval image 111 is printed as shown in FIG. 6C. At this time white space 112 is formed between the end 112A of the portion 111A printed before transportation stopped and a starting position 112B of the portion 111B printed after printing resumes. This white space occurs because the position of the print head 31 contacting the end 112A when printing was paused shifts and is not touching the starting position 112B when printing resumes.

When resuming printing from the position shown in FIG. 6B, the control unit 20 of the printer 2 according to this embodiment of the invention first feeds the receipt 101 in reverse from the normal transportation direction. The distance the receipt 101 is reversed can be, e.g., between 2 or 3 dot lines and 10 dot lines, but when the diameter of the platen 32 is large, or the configuration of the transportation unit is complicated, such as by having other feed rollers in addition to the platen 32, the receipt 101 can be reversed a greater amount. How far the paper is reversed is previously stored in the ROM 22. The operation of reversing the receipt 101 can be easily controlled by adjusting the drive current and drive pulses supplied from the motor driver 24 to the transportation motor 39.

The control unit 20 then resumes printing by the print head 31 from the position to which the paper is reversed a plurality of dot lines. In this situation, as shown in FIG. 6D, the already printed portion 111A printed before interruption and the remaining portion 111B printed after printing resumes overlap in part. By rendering such an overlapping part 113, white space is not formed between the already printed and remaining portions 111A and 111B. The lengths of the overlapping part 113 and the already printed and remaining portions 111A and 111B are equivalent to the dot line distance, e.g., 2 or 3 dot line to 10 dot line distance, that the paper is reversed.

FIG. 6E shows the configuration of the overlapping part 113 in enlarged detail. The overlapping part 113 shown in FIG. 6E is rendered by a leading part 111D of the remaining portion 111B overlapping a trailing part 111C of the already printed portion 111A, but the same data printed in the trailing part 111C is printed in the leading part 111D. More specifically, the same data already printed in the trailing part 111C of the already printed portion 111A is printed in the leading part 111D of the remaining portion 111B before the starting position 112B where normal printing resumes. In other words, the same data printed in the trailing part 111C is printed in the leading part 111D superimposed on the trailing part 111C. Lengths of the overlapping part 113, the trailing part 111C, and the leading part 111D are equivalent to the dot line distance, e.g., 2 or 3 dot line to 10 dot line distance, that the paper is reversed.

Because the same data is printed superimposed on itself, the appearance of the overlapping part 113 is not greatly different from when the trailing part 111C is printed alone (that is, not printed overlapping the leading part 111D). As a result, the formation of the white space 112 can be prevented, and the overlapping part 113 is not conspicuous. In addition, when the length of the leading part 111D is substantially equal to the distance the roll paper 100 is conveyed in reverse, the total printed length (length in the paper feed direction) of the oval image 111 does not change from that shown in FIG. 6A when the leading part 111D is printed superimposed. Good print quality that does not look odd can therefore be achieved because the total printed length does not change when the roll paper 100 is fed a specific distance in reverse and a portion of the content is reprinted overlapping a previously printed portion of the same content.

Furthermore, when printing the leading part 111D, the control unit 20 can supply less power than normal, e.g., less than an amount of power supplied when printing the already printed portion 111A, from the motor driver 24 to energize the heat elements of the print head 31 by, for example, shortening the pulse width of the pulse current applied to the print head 31. The heat energy applied from the print head 31 to the printing surface of the roll paper 100 can thereby be reduced, and the leading part 111D can be printed a lighter shade. Thus, by feeding the roll paper 100 a specific length in reverse when resuming printing, printing the leading part 111D superimposed on the trailing part 11C of the already printed portion 111A, and printing the leading part 111D a lighter shade, the white space 112 can be prevented, the overlapping part 113 can be prevented from being conspicuously darker than other content, and an undesirable appearance can be prevented. In other words, with the portion that is printed over a specific length of previously printed content printed a lighter shade than other parts, the overlapping part can be not any more conspicuous than other parts. Formation of white space can thus be prevented by printing over the same content, and the appearance of the overlapping part can not be conspicuous. Furthermore, because the energy applied to the roll paper 100 by the recording head can be lower when re-recording the specific length, this portion can be recorded light. Because the overlapping portion is therefore not more conspicuous than other parts, white space can be prevented by this superimposed recording while the overlapping part is not conspicuous.

In this embodiment that uses thermal paper that produces color in response to heat as the recording medium, and records using a line thermal head having heat elements that touch and apply heat to a recording surface of the recording medium arrayed widthwise, energizing the recording head and paper feed stop when the recording medium is to be cut. After cutting ends, the recording medium is fed a specific length in reverse before resuming energizing the recording head and paper feed, and the recording head is energized with less energy while recording a first predetermined length after printing resumes than an electric energy applied when previously recording within the portion of the image. As a result, because after stopping energizing the recording head and paper feed in order to cut the paper, the paper is fed a specific length in reverse, recording is superimposed on the same previously printed content, and the energy that energizes the recording head while recording this overlapped portion is suppressed, color can be suppressed in this overlapping portion. Therefore, when recording on thermal paper using a line thermal head, the overlapping portion will not be darker and more conspicuous than other parts, and the overlapping portion will be inconspicuous while preventing formation of white space by reprinting over the same content.

In addition, the process of reversing the roll paper 100 a specific distance and printing the leading part 111D superimposed on the trailing part 111C of the already printed portion 111A printed before printing paused as shown in FIG. 6D and FIG. 6E does not need to be executed in the space between the top logo 102 and the detail printing area 104, or between lines in the detail printing area 104, shown in FIG. 5. This is because white space 112 occurring in these spaces has no affect on the appearance of the receipt 101. The printer 2 therefore can execute the process of printing the superimposed leading part 111D only when the print head 31 is in the middle of printing an object in the image data when the cutter unit 33 cuts the paper. Note that an "object" denotes any shape included in the image data, including images, text, symbols, and other forms.

Figure 7:
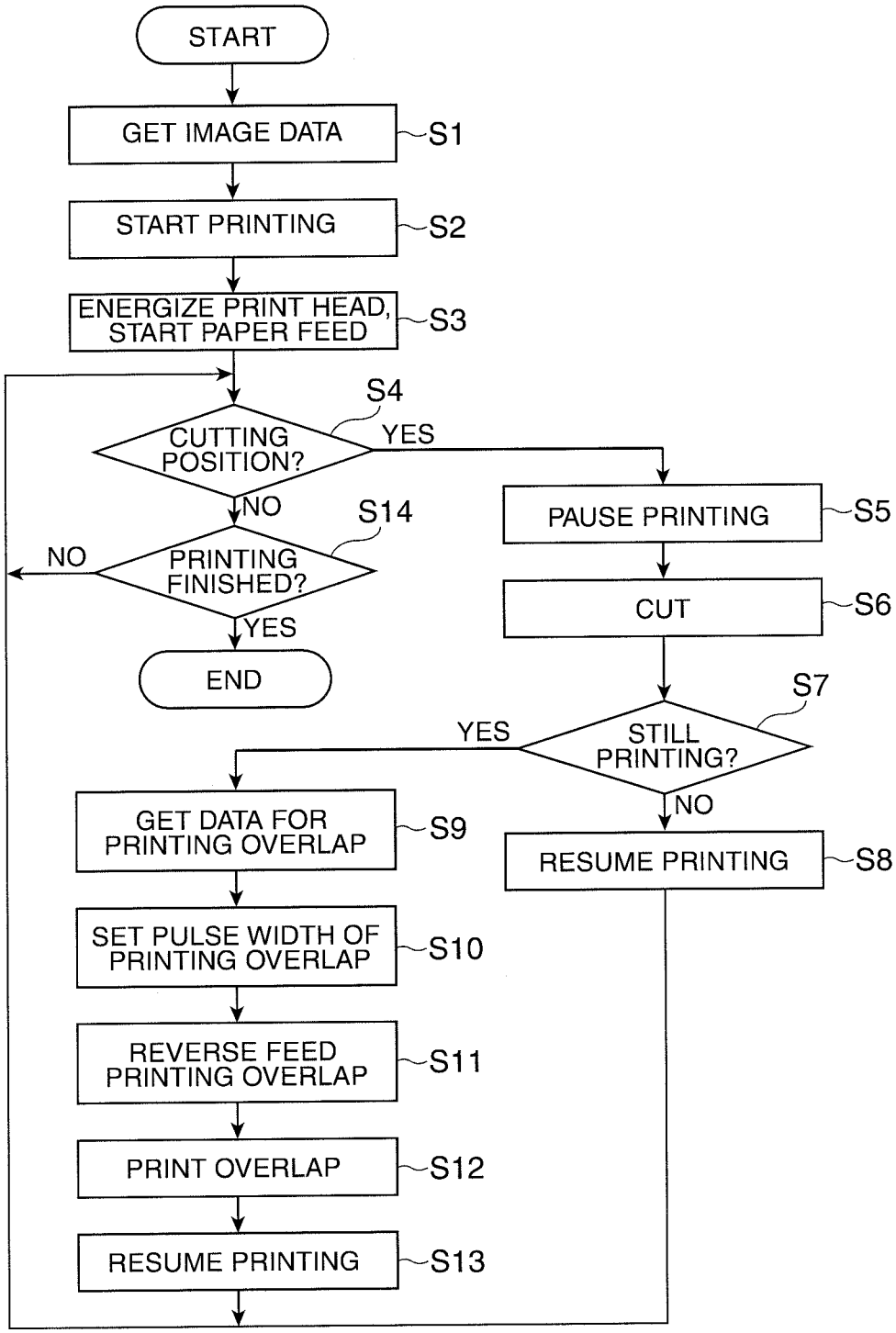
FIG. 7 is a flow chart showing one embodiment of operating the printer of FIG. 1.

FIG. 7 is a flow chart illustrating one embodiment of the operation of the printer 2.

The operation illustrated in FIG. 7 is one embodiment of the printing operation that results when the command processor 203 executes a print command.

The control unit 20 of the printer 2 first acquires image data for a logo specified by the print command from the logo image storage unit 210 where logo image data is stored (step S1), converts the acquired logo image data and text and images contained in the transaction information received with the print command to a print image in the image buffer 204 for printing by the print head 31, and then starts printing by means of the printing control unit 205 (step S2). The control unit 20 then drives the transportation motor 39 to start feeding the roll paper 100 and starts energizing the print head 31 (step S3).

While printing, the control unit 20 constantly monitors if the cutting position where the roll paper 100 is to be cut has reached the cutting position C of the cutter unit 33 (shown in FIG. 2) (step S4). If the desired cutting position has reached the cutting position C, e.g., if step S4 returns Yes, the control unit 20 stops energizing the print head 31 and transportation motor 39, and interrupts, e.g., pauses, printing (step S5). After feeding the roll paper 100 stops, the control unit 20 operates the cutter drive motor 36 to cut the roll paper 100 (step S6). Whether the roll paper 100 has reached the cutting position C can be determined in any way, such as by being determined from a rotary encoder or other type of sensor, or by being estimated from the drive pulse count if the transportation motor 39 is a stepper motor.

To resume printing, the control unit 20 determines if the print head 31 was printing an object when printing was paused (step S7). If the print head 31 was not printing an object, e.g., if step S7 returns No, the control unit 20 resumes paper feed and printing from where they were stopped in step S5 (step S8), and then returns to step S4.

However, if the print head 31 was printing the top logo 102 or other object when printing was paused, e.g., if step S7 returns Yes, the control unit 20 retrieves a specific amount of image data, such as 2 dot lines of information at the end of the portion already printed before printing was paused, from the image buffer 204 (step S9) in order to print the leading part 111D (shown in FIG. 6E), sets the pulse width of the pulse current applied to the heat elements of the print head 31 while printing the leading part 111D (step S10), and reverses the transportation motor 39 to feed the roll paper 100 a specific length, such as 2 dot lines, in reverse (step S11).

Next, the control unit 20 starts driving the transportation motor 39 and advancing the roll paper 100 while supplying current with the pulse width set in step S10 to the print head 31 to print the overlapping portion based on the data acquired in step S9 by means of the print head 31 (step S12), then resumes printing from where printing was interrupted (step S13), and returns to step S4.

The control unit 20 detects if the position where the roll paper 100 is to be cut reached the cutting position C of the cutter unit 33 during printing. If the roll paper 100 has not reached the cutting position C, e.g., if step S4 returns No, the control unit 20 determines if printing the print job directed by the command was completed (step S14). If printing is not finished, control returns to step S4 and printing continues. If printing was completed, the process ends.

As described above, in the POS terminal 1 according to this embodiment of the invention, the printer 2 has the print head 31 that prints an image containing one or more images, characters, or symbols on the roll paper 100; the platen 32 and the transportation motor 39 that convey the roll paper 100; the cutter unit 33 that cuts the roll paper 100 on which an image was printed by the print head 31; and the control unit 20 that controls the print head 31, the cutter unit 33, the platen 32, and the transportation motor 39.

The control unit 20 prints an image by means of the print head 31 while conveying the roll paper 100 by means of the platen 32 and the transportation motor 39. If the roll paper 100 is cut by the cutter unit 33 while printing is in progress, conveying the roll paper 100 by means of the platen 32 and the transportation motor 39 pauses, and after the cutter unit 33 finishes cutting the roll paper 100, the roll paper 100 is reversed a specific distance by the platen 32 and the transportation motor 39, and printing by the print head 31 is then resumed. Paper feed thus pauses when the roll paper 100 is cut by the cutter unit 33 during printing, and after cutting the roll paper 100 is completed, printing resumes after first feeding the roll paper 100 a specific length in reverse. As a result, printing overlaps for a specific distance at the position where printing paused, and a band of white space can be prevented from being formed even if the positions of the print head 31 and the roll paper 100 shift between pausing and resuming printing when printing is paused and then restarted. As a result, even if printing is interrupted to cut the roll paper 100, a band of white space is not formed and good print quality can be achieved.

A preferred embodiment of the invention is described above with reference to FIGS. 1-7, and it will be apparent to one with ordinary skill in the related art that the invention is not limited thereto.

For example, the roll paper 100 made by winding thermal paper into a roll is used as an example of the recording medium in the foregoing embodiment, but the invention is not so limited. More particularly, in other embodiments, the recording medium can include fanfold paper that is perforated at regular intervals and folded into a stack, or can include long cut sheets of a fixed size that is sufficiently longer than the length to which the sheets are to be cut.

In addition, the foregoing embodiment of FIGS. 1-7 includes the cutter unit 33 that has one fixed knife and one movable knife, but the cutter unit can be otherwise configured, and can completely cut a recording medium with a single cutting action or be configured to leave a part uncut.

Yet further, the foregoing embodiment of FIGS. 1-7 includes a configuration in which the roll paper 100 is held between the platen 32 and the print head 31, and the roll paper 100 is conveyed by rotation of the platen 32, but the invention is not so limited. For example, a configuration that conveys a recording medium by means of a plurality of transportation rollers is also conceivable, and such a configuration can have a roller for conveying the recording medium in a forward direction and another roller for conveying the recording medium in a reverse direction. A configuration in which the single transportation motor 39 is driven in forward and reverse directions is also described above with reference to FIGS. 1-7, but a configuration having a separate motor for conveying a recording medium in a reverse direction in addition to a transportation motor such as the transportation motor 39 is also conceivable, and the specific feed mechanism can be desirably configured.

Yet further, the above embodiment FIGS. 1-7 describes changing the pulse width of the pulse current that energizes the print head 31 in order to reduce the print density, e.g., gray level, produced by the print head 31, but the invention is not so limited. For example, current or voltage may be adjusted instead.

In addition, when thermal paper that produces a plurality of colors according to the temperature of the heat applied thereto is used as the recording medium, the control unit 20 may adjust current, voltage, or pulse width of the pulse current that energizes the print head 31 so that the color produced while printing the leading part 111D is the same but the gray level is lower, e.g., the color is lighter. Other details concerning the specific configuration of the printer 2 can also be changed desirably.

The recording device to which the invention can be applied is not specifically limited and can be any type of printer that can print previously stored image data. The invention can also be applied to printers that are incorporated into other devices, and can be applied to configurations that control a printer in the same way as the foregoing control unit 20 by means of a print control device disposed separately to the printer. The invention can also be applied to printers that can stop feeding a recording medium while printing, such as serial printers that have a recording head mounted on a carriage.

The various processes of a recording device described herein can also be rendered as a program. This program can be provided stored on a recording medium such as a hard disk drive, an optical disc, a magneto-optical disc, flash memory, or other type of storage device.

As a result of executing this program, e.g., by a control unit, a recording device that records images by means of a recording head while conveying a recording medium can stop feed of the recording medium by the transportation unit when the recording medium is to be cut by a cutter unit during recording, and when cutting the recording medium is completed, feed the recording medium a specific length in the opposite direction as the normal feed direction and then resumes recording. As a result, recording overlaps for a specific length at the position where recording stopped, and formation of a band of white space can be prevented when recording stops and resumes even when the positions of the recording head and recording medium have shifted between when recording stops and resumes. A band of white space is therefore not formed even when recording stops and the recording medium is cut, and good print quality can be achieved. Because the recording medium is fed a specific length in reverse after cutting the recording medium is completed and before resuming recording, bands of white space are not formed even when recording is stopped and the recording medium is cut, and good print quality can be achieved.

The invention being thus described, it will be apparent to one skilled in the art that it may be varied in many ways. Such variations are not to be regarded as a departure from the spirit and scope of the invention, and all such modifications as would be apparent to one skilled in the art are intended to be included within the scope of the following claims.

What is claimed is:

1. A recording device comprising:

a recording head that records an image on a recording medium;

a transportation unit that conveys the recording medium;

a cutter unit that cuts the recording medium on which image data for the image is recorded by the recording head;

a control unit that controls the recording head, the cutter unit, and the transportation unit; and an image storage unit that stores the image data for the image recorded on the recording medium;

wherein the control unit conveys the recording medium using the transportation unit, causes the recording head to record the image on the recording medium based on the image data stored in the image storage unit, stops conveyance by the transportation unit and cuts the recording medium using the cutter unit at a specific recording position in the image recorded by the recording head, and when cutting the recording medium ends, conveys the recording medium a specific length in reverse using the transportation unit, and then, with the recording medium conveyed the specific length, resumes recording the image by the recording head including within a portion of the image already recorded before conveying the recording medium stopped.

2. The recording device described in claim 1, wherein:

when the recording medium is conveyed in reverse using the transportation unit and recording by the recording head resumes, the control unit records the image within the portion of the image already recorded before conveyance of the recording medium stopped with a lighter gray level than a gray level used to already record within the portion of the image.

3. The recording device described in claim 1, wherein:

the image is recorded on a recording surface of the recording medium by applying energy to the recording head; and when the recording medium is conveyed in reverse using the transportation unit and recording by the recording head resumes, the control unit applies less energy to the recording head while recording the image within the portion of the image already recorded before conveyance stopped.

4. The recording device described in claim 1, wherein:

the recording medium comprises thermal paper that produces color in response to heat;

the recording head comprises a line thermal head having heat elements that contact and apply heat to a recording surface of the recording medium arrayed widthwise to the recording medium; and the control unit energizes the recording head and records on the recording medium while conveying the recording medium using the transportation unit, stops paper conveyance by the transportation unit and stops energizing the recording head when the recording medium is cut by the cutter unit during recording, resumes energizing the recording head and paper conveyance by the transportation unit after conveying the recording medium in reverse the specific length after cutting the recording medium by the cutter unit ends, and while recording a first predetermined length after printing resumes, energizes the recording head with less electric energy than an electric energy applied when previously recording within the portion of the image.

5. The recording device described in claim 1, wherein:

the recording head resumes recording the image within an entire portion of the image already recorded before conveying the recording medium stopped.

6. A recording device control method that controls a recording device that stores image data for an image on a recording medium, records the image on a recording medium using a recording head, conveys the recording medium using a transportation unit, and cuts the recording medium on which the image was recorded by the recording head using a cutter unit, the control method comprising steps of:

conveying the recording medium using the transportation unit;

recording on the recording medium using the recording head based on the image data for the image stored in an image storage unit;

stopping conveyance by the transportation unit and cutting the recording medium using the cutter unit at a specific recording position in the image recorded by the recording head; and when cutting the recording medium ends, conveying the recording medium a specific length in reverse using the transportation unit, and then, with the recording medium conveyed the specific length, resuming recording the image by the recording head including within a portion of the image already recorded before conveying the recording medium stopped.

7. The recording device control method described in claim 6, wherein:

when the recording medium is conveyed in reverse using the transportation unit and recording by the recording head resumes, the image within the portion of the image already recorded is recorded before conveyance of the recording medium stopped with a lighter gray level than a gray level used to already record within the portion of the image.

8. The recording device control method described in claim 6, wherein:

when the recording medium is conveyed in reverse using the transportation unit and recording by the recording head resumes, less energy is applied to the recording head while recording the image within the portion of the image already recorded before conveyance stopped.

9. The recording device control method described in claim 6, wherein:

the recording medium comprises thermal paper that produces color in response to heat;

the recording head comprises a line thermal head having heat elements that contact and apply heat to a recording surface of the recording medium arrayed widthwise to the recording medium; and the recording head is energized and the recording medium is recorded on while the recording medium is conveyed using the transportation unit, paper conveyance by the transportation unit is stopped and energizing of the recording head is stopped when the recording medium is cut by the cutter unit during recording, energizing of the recording head and paper conveyance by the transportation unit resumes after conveying the recording medium in reverse the specific length after cutting the recording medium by the cutter unit ends, and while recording a first predetermined length after printing resumes, the recording head is energized with less electric energy than an electric energy applied when previously recording within the portion of the image.

10. The recording device control method described in claim 6, wherein:

the recording head resumes recording the image within an entire portion of the image already recorded before conveying the recording medium stopped.

11. A computer-readable recording medium that stores a program executed by a control unit that controls a recording device that stores image data for an image on a recording medium, records the image on a recording medium using a recording head, conveys the recording medium using a transportation unit, and cuts the recording medium on which the image was recorded by the recording head using a cutter unit, the program executed by the control unit comprising steps of:

conveying the recording medium using the transportation unit;

recording on the recording medium using the recording head based on the image data for the image stored in an image storage unit;

stopping conveyance by the transportation unit and cutting the recording medium using the cutter unit at a specific recording position in the image recorded by the recording head; and when cutting the recording medium ends, conveying the recording medium a specific length in reverse using the transportation unit, and then, with the recording medium conveyed the specific length, resuming recording the image by the recording head including within a portion of the image already recorded before conveying the recording medium stopped.

* * * * *